US008231198B1

(12) United States Patent
Askeland et al.

(10) Patent No.: US 8,231,198 B1
(45) Date of Patent: Jul. 31, 2012

(54) METHOD FOR PRINT HEAD SERVICE DURING CONTINUOUS PRINTING

(75) Inventors: Ronald A Askeland, San Diego, CA (US); William S Osborne, Camas, WA (US); Thomas M Sabo, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/433,775

(22) Filed: Mar. 29, 2012

Related U.S. Application Data

(62) Division of application No. 11/906,687, filed on Oct. 3, 2007, now Pat. No. 8,172,359.

(51) Int. Cl.
*B41J 2/165* (2006.01)

(52) U.S. Cl. ..... 347/23

(58) Field of Classification Search ..... 347/22, 347/23

See application file for complete search history.

(56) References Cited

U.S. PATENT DOCUMENTS

| | | | |
|---|---|---|---|
| 5,963,770 | A | 10/1999 | Eakin |
| 6,203,135 | B1 | 3/2001 | Murcia et al. |
| 6,481,822 | B2 | 11/2002 | Murcia et al. |
| 6,789,873 | B2 | 9/2004 | Booth |
| 6,896,349 | B2 | 5/2005 | Valero et al. |
| 7,207,668 | B2 | 4/2007 | Jones et al. |
| 7,901,029 | B2 | 3/2011 | Baker |
| 2006/0139396 | A1 | 6/2006 | Baker |
| 2006/0275532 | A1 | 12/2006 | Dechert |

FOREIGN PATENT DOCUMENTS

EP 1462264 9/2004

OTHER PUBLICATIONS

"Remarks" received Aug. 24, 2011 in U.S. Appl. No. 11/906,687.*

* cited by examiner

*Primary Examiner* — Jerry Rahll

(57) ABSTRACT

A method of printing with a printing system comprising an array of print heads, the array of print heads including a redundant print head, and a service station, includes, with the redundant print head located at the service station, printing using a remainder of the array of print heads; and positionally and functionally replacing a second print head in the array with the redundant print head while printing continues.

14 Claims, 7 Drawing Sheets

METHOD FOR PRINT HEAD SERVICE DURING CONTINUOUS PRINTING

RELATED APPLICATION

The present application is a divisional and claims priority under 35 U.S.C. 120 of U.S. patent application Ser. No. 11/906,687, filed Oct. 3, 2007, and entitled, "SYSTEM AND METHOD FOR PRINT HEAD MAINTENANCE DURING CONTINUOUS PRINTING," now U.S. Pat. No. 8,172,359 which is incorporated herein by reference in its entirety.

BACKGROUND

This disclosure relates to ink jet printing systems (whether drum-type, web-type, or cut sheet printers, for example) that use a page-wide array of print heads. A page-wide array typically includes multiple ink jet print heads positioned at fixed locations across the width of a print zone. Each print head is operated to eject ink to print desired indicia upon the portion of the print media that passes below it.

In order to maintain good image quality, drop-on-demand inkjet print heads require maintenance operations (spitting, wiping, priming, etc.) to maintain optimum print quality during long print jobs. An improperly maintained print head can become clogged and/or become the source of dot placement errors that reduce print quality. However, one challenge associated with ink jet printing systems having a page-wide array of print heads is servicing the print heads while causing a minimum of down time for the printer system. Printing can be periodically shut down to service the print heads, but this approach is reduces the time during which the printer is operational.

BRIEF DESCRIPTION OF THE DRAWINGS

Various features and advantages of the present disclosure will be apparent from the detailed description which follows, taken in conjunction with the accompanying drawings, which together illustrate, by way of example, features of the present disclosure, and wherein.

DETAILED DESCRIPTION

Figure 1:
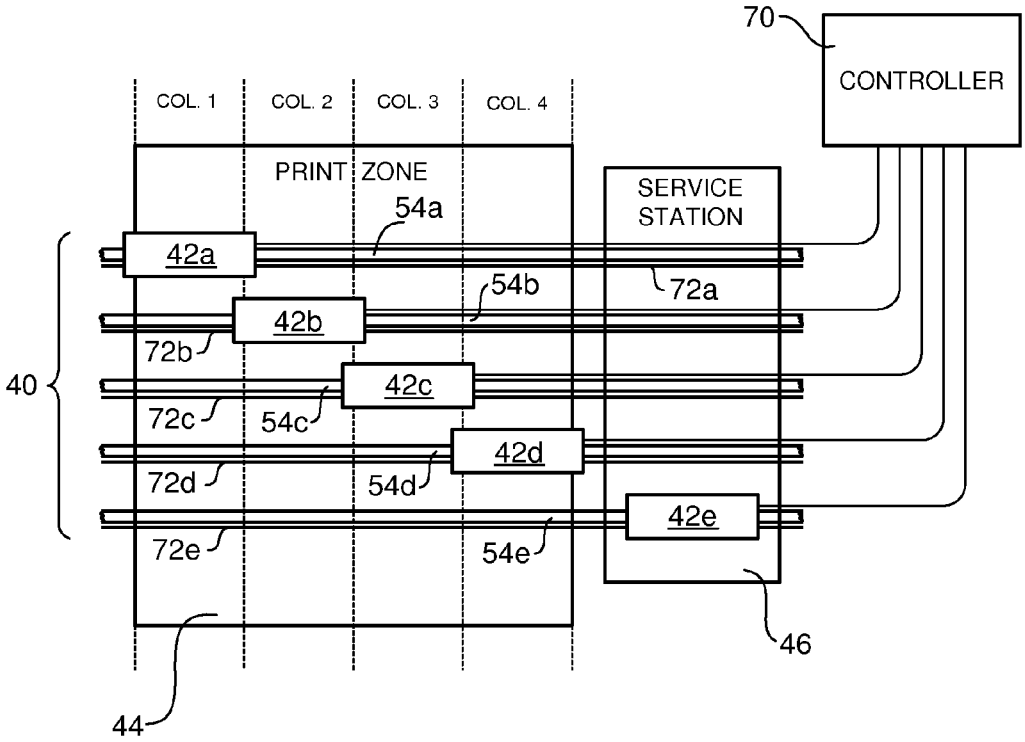
FIG. 1 is a schematic diagram of one embodiment of a page-wide array of print heads configured to allow print head maintenance during continuous printing.

Reference will now be made to exemplary embodiments illustrated in the drawings, and specific language will be used herein to describe the same. It will nevertheless be understood that no limitation of the scope of the present disclosure is thereby intended. Alterations and further modifications of the features illustrated herein, and additional applications of the principles illustrated herein, which would occur to one skilled in the relevant art and having possession of this disclosure, are to be considered within the scope of this disclosure.

The present disclosure relates generally to servicing of ink jet print heads in ink jet printers that use a page-wide array of print heads. Such printers can include drum-type, web-type, and cut sheet printers, for example. In a drum-type printer, for example, a page-wide array of print heads can be positioned over a rotating drum, which rotates and carries pages of print media past the print head. The print media can occupy a print zone on the drum, and each print head can be positioned to eject ink drops within a discrete region of the print zone as the media passes by. Drum-type and other ink jet printers can be configured to print onto the print media in one or more passes, and in one direction or bidirectionally (e.g. printing can occur with the drum rotating clockwise and then counterclockwise in one or more sequences).

The number of print heads can vary. A schematic diagram of one embodiment of a page-wide array 40 is provided in FIG. 1. This embodiment includes four print heads 42*a-d* that are arranged at four discrete positions (labeled as Col. 1-4) within a print zone 44, with a fifth redundant print head 42*e*, which will be discussed in more detail below. It is to be understood that while the page-wide array is shown in a planar configuration, this is for illustrative purposes, and does not necessarily represent the actual appearance of a page-wide array of print heads. For example, in a drum-type printer, the print heads will be radially oriented with respect to the printer drum.

As noted above, in order to maintain good image quality, proper maintenance of the condition of the print heads is desirable. An improperly maintained print head can become clogged and/or become the source of dot placement errors that reduce print quality. Accordingly, drop-on-demand inkjet print heads perform maintenance operations (e.g. spitting, wiping, priming, etc.) to maintain optimum print quality during long print jobs. Offline drop detection can also be used to determine if nozzles require additional servicing or to provide data for nozzle replacement algorithms.

Unfortunately, performing proper maintenance of ink jet print heads without interrupting the printing process presents a significant challenge. One approach that has been used for print head maintenance is to periodically shut down printing, service the print heads, and then start printing again. This approach is inefficient and reduces the printer's operational time. Another approach that has been tried with a page-wide array is to have two fully redundant page wide arrays of print heads so that one array can be serviced while the other array is used for printing. Unfortunately, this approach is wasteful and expensive because it doubles the required number of print heads.

To allow for print head servicing operations during continuous printing, the inventors have developed a page-wide array that is partially redundant, having one or more redundant print heads. This allows multiple print heads in the page-wide array to be printing images, while the one or more redundant print heads are undergoing servicing routines.

Figure 2:
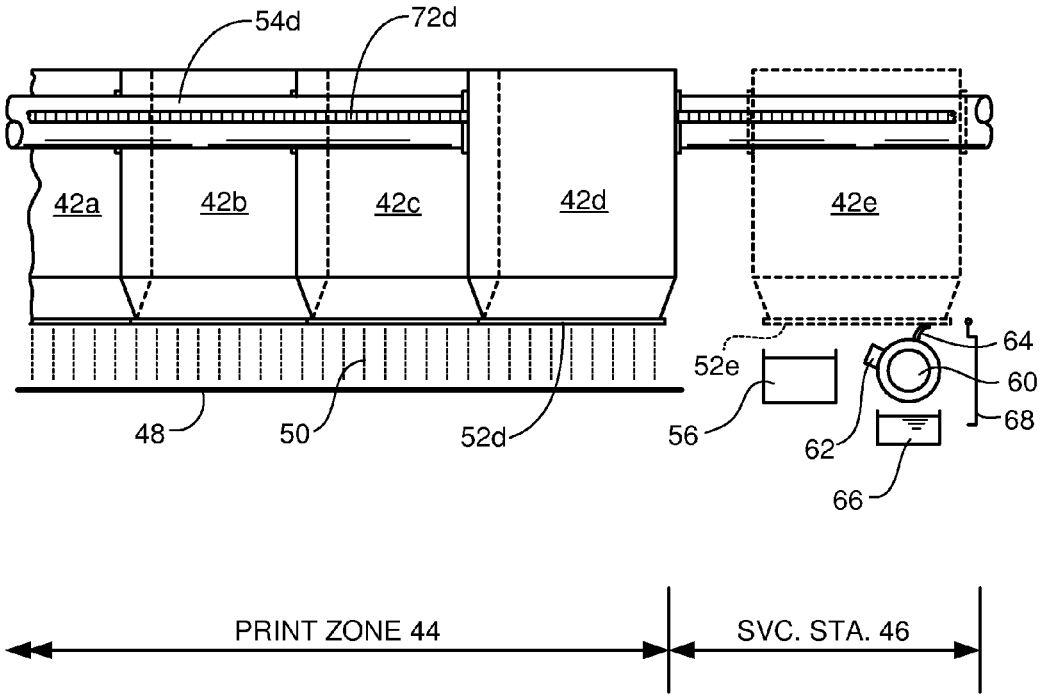
FIG. 2 is a partial side, elevational view of an array of print heads and service station in a system configured like that of FIG. 1.

Shown in FIGS. 1-4 are illustrations that depict one embodiment of a system for print head maintenance during continuous printing. In the embodiment of FIG. 1, a service station 46 is located adjacent to the print zone 44. An elevational view of the portions of the printer system shown in FIG. 1, showing the service station and its relationship to the moveable print heads 42, is provided in FIG. 2. The service station as shown in FIG. 2 is intended to be representational in nature, and does not necessarily show the actual appearance of an ink jet print head service station. A series of print heads 42*a-d* are positioned above print media 48, and each ejects ink drops, represented by dashed lines 50, from its orifice plate 52 (which provides a nozzle layer) onto the media within a particular columnar portion (labeled as Col. 1-4 in FIG. 1) of the print zone 44. The print heads 42 each include a carriage structure that is mounted upon a carriage rod 54, which allows the print heads to be moved from the print zone to the service station 46 when needed.

A print head service station 46 usually includes a waste ink collector 56, called a "spittoon", into which a number of drops of ink can be periodically ejected, or "spit", from each nozzle of a print head to flush out drying ink. If spitting is not performed, the first few drops ejected from each nozzle can have poor trajectory or be of low optical density, potentially resulting in visible image or print quality defects. The service station can also include a priming and wiping assembly, which can include a rotating drum 60 that includes a primer application pad 62 and a wiper 64. The primer application pad is configured to rotate down toward a primer reservoir 66 to contact liquid primer (which is essentially ink solvent) held in the reservoir, and then rotate up to wipe the solvent onto the orifice plate of 52 of the print head that is located at the service station. This wiping action helps to dissolve accumulated ink residue from the orifice plate. The drum can then rotate to cause the wiper to wipe across the orifice plate to remove the solvent and dissolved ink and other contaminants. The service station can also include a cap 68 that can be closed over the print head after servicing, to further reduce the likelihood that the ink jet nozzles will dry out.

As noted above, the individual print heads 42 are each mounted on a carriage rod 54, which provides a lateral transfer device that allows the print heads to be independently moved from the print zone 44 to the service station as needed. While the details of the mechanism that moves the print heads along the carriage rods is not shown in the figures, this type of mechanism is well known to those of skill in the art. The print heads are also each interconnected to a controller 70, which controls the flow of data and other commands to the print heads. The page-wide array can also include an encoder system, including an encoder strip or rod 72 that is associated with each print head in FIGS. 1 and 2. The encoder rods are arranged parallel to each carriage rod 54, and include a series of high precision tick marks that can be optically detected (using hardware included within each print head) to identify the position of the carriage. The encoder rods can have 1200 or more marks per inch, for example, allowing very accurate placement of the carriage. The encoder system allows each print head to be accurately positioned at any desired position along its respective carriage rod, so that print heads can be moved into and out of the print zone and always be accurately repositioned at any column position in the array. While encoder rods are only shown in FIGS. 1 and 2, it is to be understood that the other embodiments shown and described herein can also include this type of system for allowing accurate repositioning of the print heads. At the same time, other systems for detecting the lateral position of the print heads can also be used, in addition to the type of encoder system described here.

The embodiment of FIG. 1 provides a 4 print head page-wide array with one redundant print head. In FIG. 2 print heads 42*a-d* are in the print zone 44, in position for printing an image. Print head 42*a* will print image portions within Col. 1, print head 42*b* will print in Col. 2, and so on. Print head 42*e*, on the other hand, is positioned at the service station 46, in a position to undergo maintenance routines (e.g. spitting, priming, wiping), as discussed above. This configuration allows the page-wide array to continue printing while the servicing of print head 42*e* takes place, without interrupting printing at all.

Figure 3:
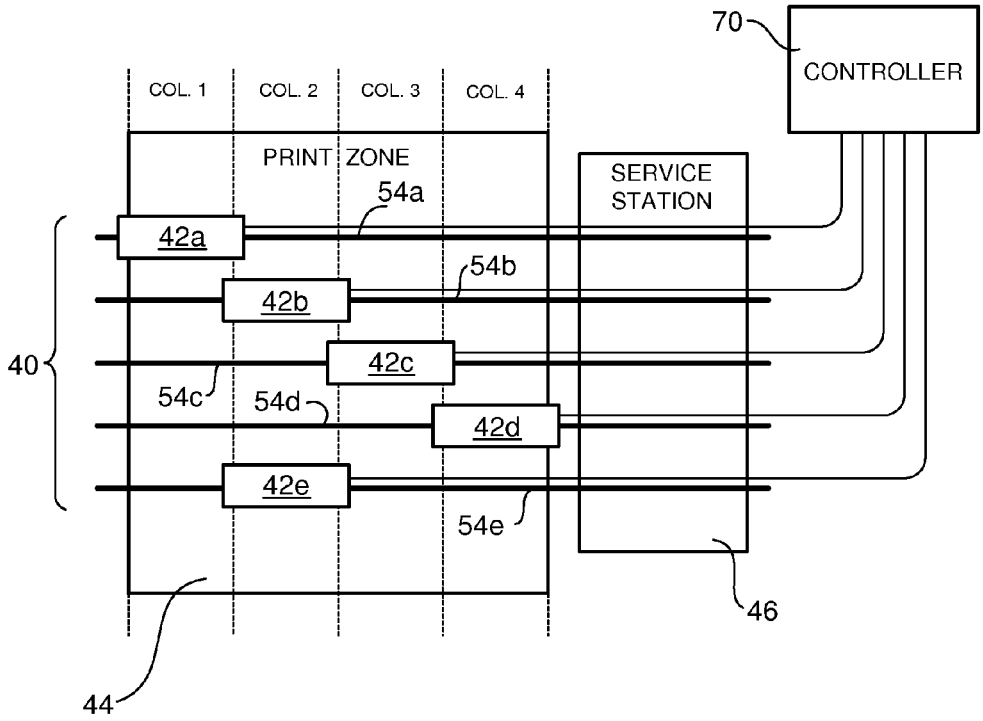
FIG. 3 is a schematic diagram showing one stage in the movement of a redundant print head into a printing position in the page-wide array.

After servicing of print head 42*e* is complete (or following some specified time interval thereafter), this redundant print head can be moved from the service station 46 back to the print zone 44, to take a position in one of the print column positions (Cols. 1-4). In the present example, the controller 70 recognizes print head 42*e* as the redundant print head that has recently been serviced, and identifies print head 42*b* as the next print head to be serviced. Accordingly, the controller causes print head 42*e* to be moved from the service station to the position of the new print head to be serviced—i.e. Col. 2, the position of print head 42*b*. This condition is shown in FIG. 3. Again, printing can continue during the movement of the redundant print head to a new position in the print zone.

At this point the printing system undertakes a changeover routine to allow the redundant print head (42*e*) to be functionally exchanged with the new print head to be serviced (42*b*), making that new print head the redundant print head. At the beginning of the changeover operation, print heads 42*b* and 42*e* are both in the second from the left position (Col. 2) of the page-wide array, as shown in FIG. 3. To accomplish the changeover, the controller 70 shifts data from print head 42*b* to print head 42*e*. That is, the print data that was being sent to print head 42*b* is rerouted to print head 42*e*, allowing that print head to takeover the printing operations formerly performed by print head 42*b*. This data shift can be performed at a page break or some other point without interrupting the printing process.

Figure 4:
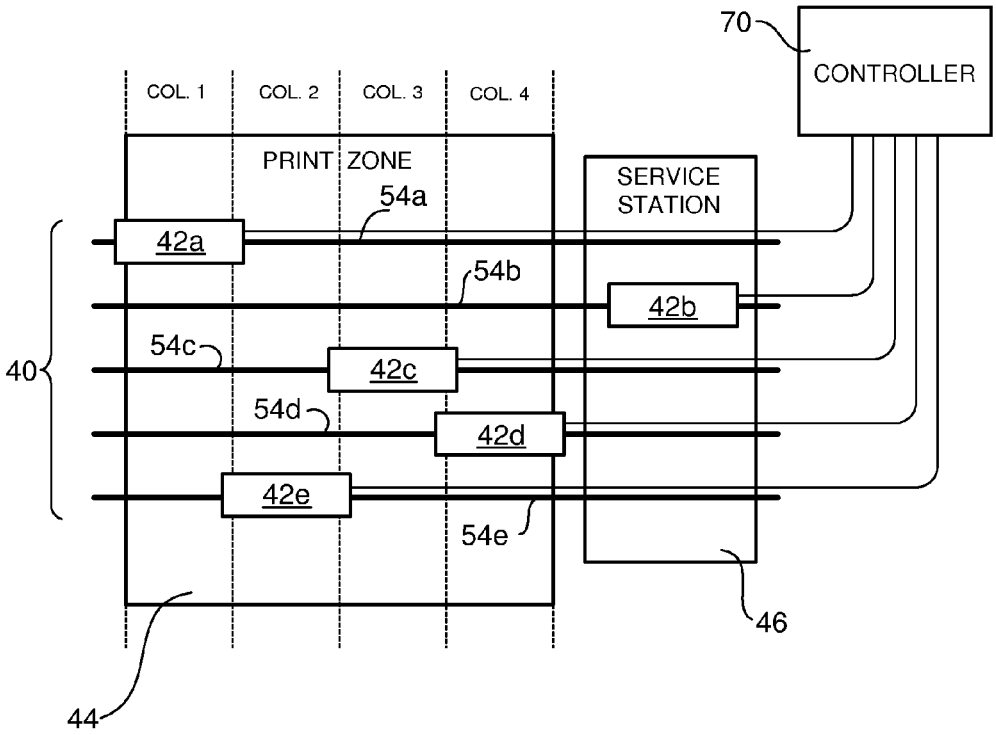
FIG. 4 is a schematic diagram showing a new print head moved into the service station, with the redundant print head now occupying its former printing position in the page-wide array.

Once the data that was flowing to print head 42*b* has been rerouted to print head 42*e*, print head 42*b* becomes the redundant print head, and can be moved from the print zone 44 to the service station 46 to undergo servicing. This condition is shown in FIG. 4. Once print head 42*b* is serviced, the process can be repeated to allow all of the print heads to be serviced regularly without interrupting printing. That is, after servicing of print head 42*b* is complete, it can be positionally exchanged with one of the other print heads (presumably not print head 42*e*) to allow that print head to be serviced, and so on.

Figure 5:
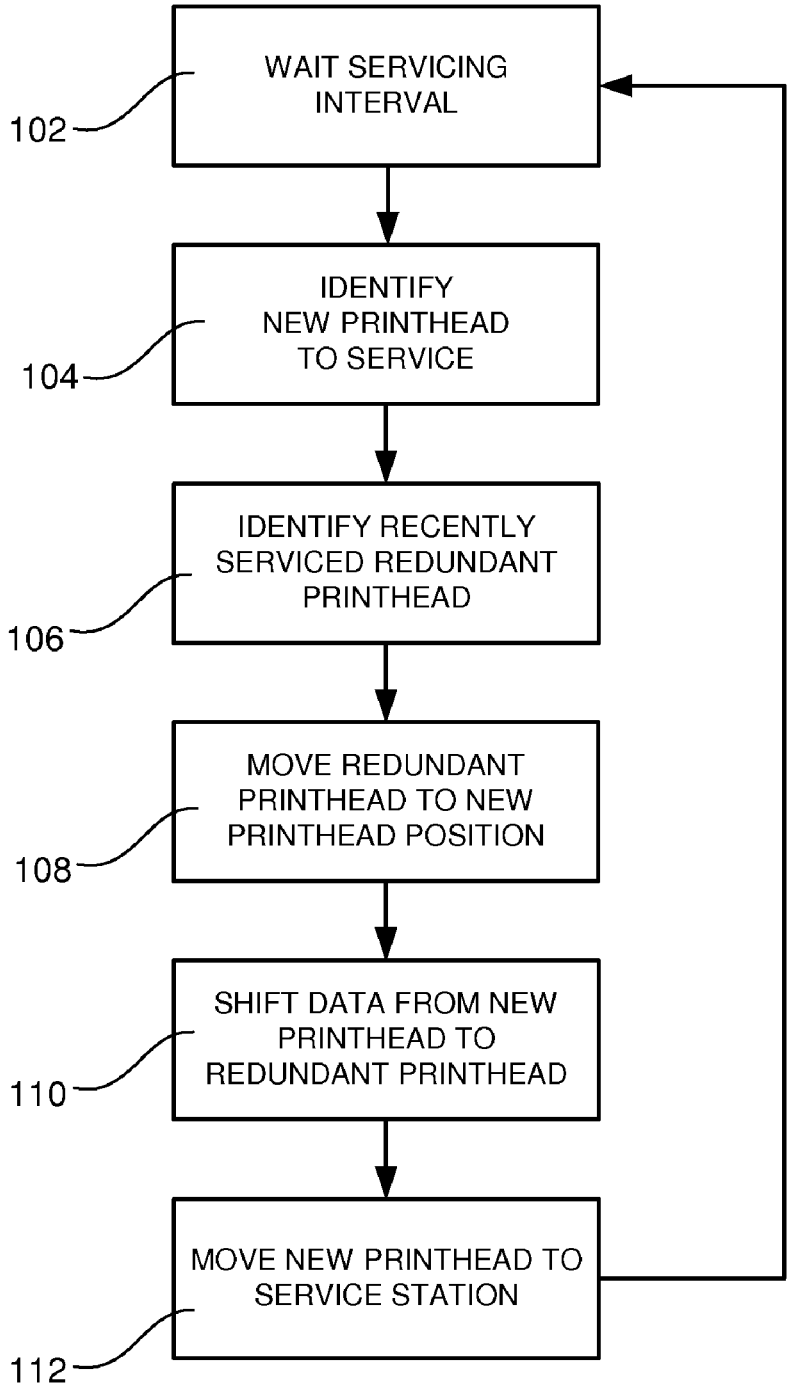
FIG. 5 is a flow chart showing the steps in one embodiment of a method for print head maintenance during continuous printing.

The process that has been discussed above is outlined in FIG. 5, which provides a flow chart of the steps in one embodiment of a method for printing during servicing of an ink jet print head. The method can start at step 104 by identifying a new print head that needs servicing, and also identifying a recently serviced redundant print head that is at the service station (step 106). The redundant print head is moved to a discrete position in the page-wide array that is the position of the new print head (step 108), and the data is then shifted from the new print head to the redundant print head (step 110) to allow the redundant print head to take over the printing formerly performed by the new print head. Accurate positioning of the print heads at the discrete positions can be facilitated by use of a print head transfer mechanism having an encoder system, as discussed herein.

At this point the new print head becomes the redundant print head, and can be moved to the service station for servicing (step 112). Steps 108-112 together can be viewed as representing the process of positionally and functionally interchanging the redundant print head for a new print head of the page-wide array. After the new print head has been serviced, the system can immediately repeat the process to exchange that print head for another in the array, or the system can wait a time interval (step 102) before proceeding. Advantageously, all of the steps in this method can take place while continuously printing using multiple print heads in the page-wide array.

The invention thus provides a system and method for servicing ink jet print heads during continuous printing, and applies to drum-type, web-type, or cut sheet printers. It provides an ink jet printer system having a plurality of print heads, including at least one redundant print head. Each print head is positionally and functionally interchangeable between a plurality of discrete positions of a page-wide array using a lateral transfer device or carriage, and is also independently moveable between the service station and the plurality of discrete positions, to allow continuous printing during servicing of the redundant print head. This provides page-wide printer architecture that enables continuous printing while servicing any one of multiple print heads. The lateral transfer device can include an encoder system configured to ensure substantially accurate repositioning of each print head at each of the discrete positions in the page-wide array after servicing, so that print quality is not affected by inaccurate print head positioning. While the lateral transfer device is depicted herein as a carriage system, other types of systems for positionally interchanging the redundant portion of the array with part of the non-redundant portion of the array can be used.

While the examples illustrated and discussed above relate to a page-wide array having four active print heads and one redundant print head, these numbers are only exemplary. Additionally, while the embodiments discussed above include only one service station and only one print head on each print head carriage rod, multiple service stations can be provided, and multiple print heads can be associated with a single carriage rod. Moreover, the system can include print bars having multiple print heads, and more than one such print bar can be attached to a given carriage rod.

Figure 6:
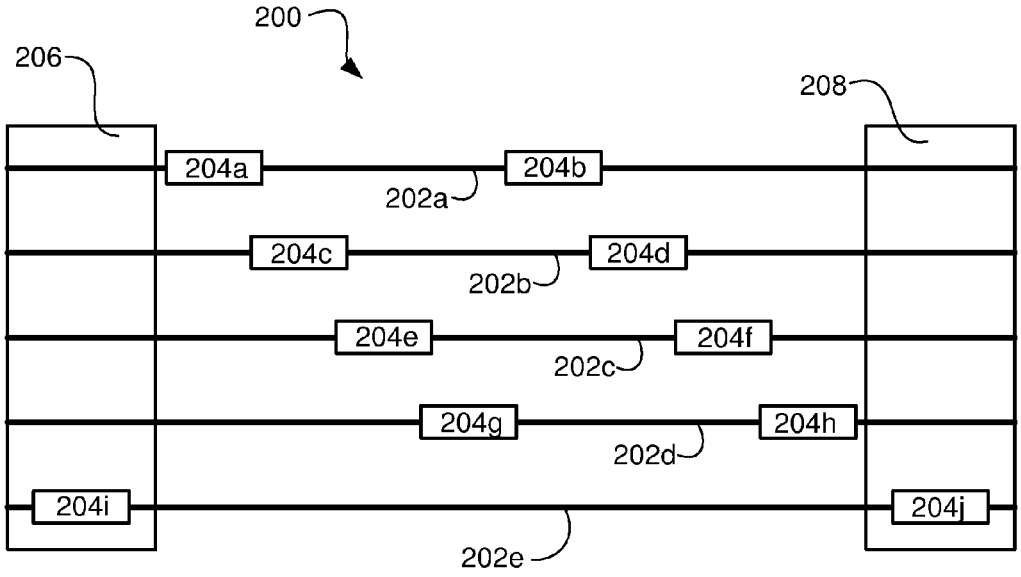
FIG. 6 is a schematic diagram of an alternative embodiment of a printer system having a page-wide array with two service stations.

One example of an alternative embodiment of a partially redundant page-wide array is given in FIG. 6. This system 200 includes five print head carriage rods 202, with two print heads 204 attached to each rod. Additionally, there are two service stations 206, 208 located at opposite ends of each carriage rod. This system is configured to provide a wider page format, allowing printing on relatively wide print media. The ten print heads, labeled 204*a-j*, are configured to align with respect to eight print head positions or columns across the page width. If each column is 4 inches wide, this page-wide array will allow printing on media that is 32 inches wide. Using eight print heads for printing leaves two redundant print heads, which can be serviced at one of the service stations. For example, print heads 204*i* and 204*j* are positioned at service stations 206 and 208, respectively. Following servicing, these print heads can be positionally and functionally interchanged with almost any of the other print heads to allow continuous printing.

The configuration of FIG. 6 does present some functional limitations. For example, it is expected that both print heads on a given carriage rod cannot print in adjacent columns of the page-wide array at the same time because the physical size of a given print head is generally wider than the actual print width (i.e. the print head body is wider than the actual ink jet nozzle array). This condition necessitates a gap in the printing position between print heads on a given carriage rod. However, it is believed that this feature of the system can be easily dealt with.

Additionally, while any print head in the system of FIG. 6 can print at any lateral position in the array, it is anticipated that the service station on each side of the array will service the print heads that are on the same side of each carriage rod. For example, service station 206 will service print heads 204*a-e*, and service station 208 will service print heads 204*f-j*. Otherwise, the print head from the side near the service station would be blocked from leaving the service station during servicing of the other print head.

It will be apparent that the system shown in FIG. 6 (and other embodiments depicted herein) could be configured in other ways. For example, the system could be configured with an additional inactive print head position beyond each service station, or with two service positions along each carriage rod at each service station, to allow both print heads on a given carriage rod to be serviced at one station. These alternatives, however, are considered to be less practical, and require additional redundant hardware. As another alternative, the configuration shown in FIG. 6 could be provided with just a single service station on one side for servicing of all print heads, though this configuration would, again, prevent the use of the print head nearest to the service station during servicing of the print head farther from the service station on that same carriage rod.

Figure 7:
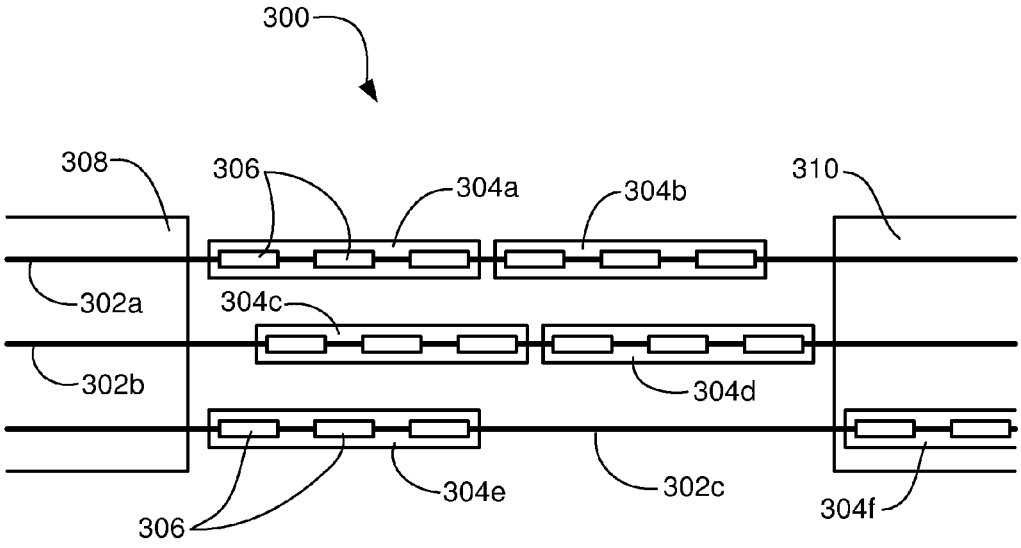
FIG. 7 is a schematic diagram of an alternative embodiment of a printing system having a partially redundant page-wide array with multiple print heads on each print bar, and two service stations.

To provide a more compact system, multiple print heads can be associated with a single print bar that is attached to each carriage rod, and multiple print bars can be associated with a single carriage rod. Such a system is shown in FIG. 7. This printing system 300 includes three carriage rods 302*a-c*, which each include two print bars 304*a-f*. Each print bar in turn includes three print heads 306. Two service stations 308, 310 are provided on each side of the print head array. The principles of partial redundancy discussed herein apply equally to a single print head and to a print bar having multiple print heads positioned thereon. A redundant print head or print bar can be moved to a service station for servicing during continuous printing in the same manner. Accordingly, the term "print head" as used in the claims is intended to encompass both a single print head and a print bar having multiple print heads.

The provision of six print bars 304 in a page-wide array that requires four print bars to cover the full page width provides a partially redundant array, allowing up to two of the six print bars to be serviced at any given time, and then functionally and positionally interchanged with the other print bars during continuous printing. As shown in the figure, print bar 304*f* is positioned at the right service station 310. As with the system depicted in FIG. 6, it is presumed that the print bars on the left will be serviced at the service station 308 that is on the left, and the print bars on the right will be serviced at the service station 310 that is on the right, though the system could be configured differently, as discussed above.

The page-wide array shown in FIG. 7 can be used for wide format printing. For example, the individual print heads 306 can each have a print width of 4 inches. For printing, the print bars are positioned so that the print heads are staggered, thus covering the entire page width using four of the six print bars. The system shown in FIG. 7 thus has 12 printing columns, which at 4 inches each provides a total printing width of 48 inches. Given the existence of the two redundant print bars, however, the system can continuously print while any one or two of the print bars are being serviced.

Figure 8:
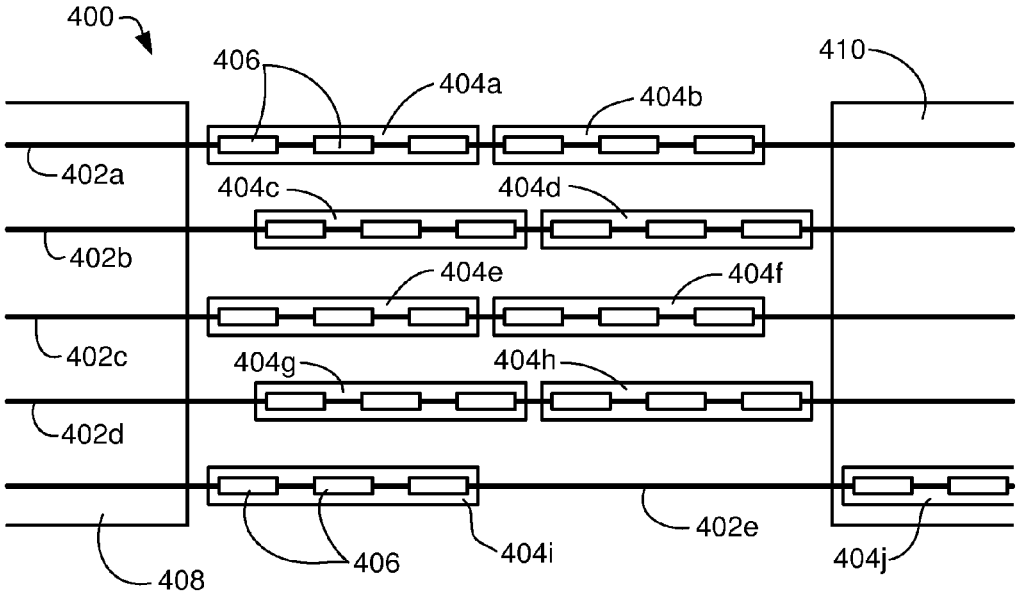
FIG. 8 is a schematic diagram of another embodiment of a page-wide array with multiple print bars and two service stations.

Another embodiment of a partially redundant page-wide array is shown in FIG. 8. In this embodiment, the system 400 includes 5 print head carriages 402, with 10 moveable print bars 404*a-j* mounted upon them, each print bar including three print heads 406. As with the embodiment of FIG. 7, one or two of the print heads can be moved left or right to either of the service stations 408, 410 for servicing while the remaining print heads are printing.

Unlike the embodiment of FIG. 7, the embodiment of FIG. 8 is a multi-pass printing system, in which two print heads are positioned in each print column, so that ink is provided to the same portion of the print media by two different print heads. This type of system can be used to provide multi-pass ink jet printing without reversal of the direction of the print media. Those of skill in the art will be aware of ink jet printing systems that apply ink to the print media in more than one pass, in order to provide the proper coverage. For example, photo printing and other high color saturation applications can require the application of more ink than a given print head can eject in a single pass. Where a multi-pass page-wide array is not used, it is necessary to reverse the direction of the print media to allow a given print head to print twice. However, to reduce heat generation, wear and tear, and other potential problems, a multi-pass page-wide array like that of FIG. 8 can be used to provide adequate ink coverage. The existence of multiple active print heads positioned to cover a given column in a page-wide array is not to be confused with the term "partially redundant" as that term is used herein. For the purposes of this disclosure, the multiple print heads covering a given column in a multi-pass page-wide array like that of FIG. 8 are not to be considered redundant when they are the active print heads.

Figure 9:
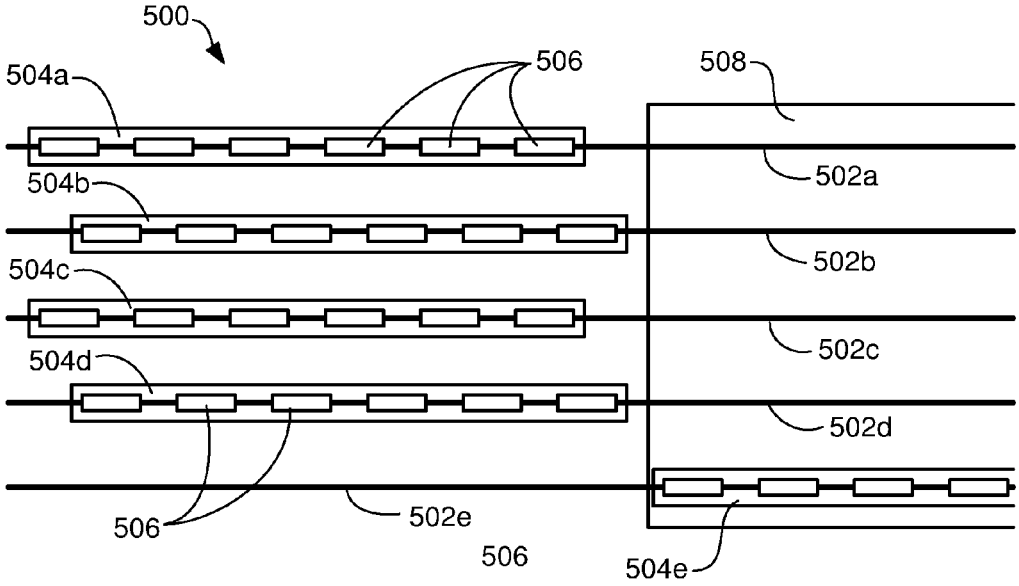
FIG. 9 is a schematic diagram of another embodiment of a partially redundant page-wide array having multiple print head print bars and a single service station.

Another embodiment of a partially redundant multi-pass page-wide array is shown in FIG. 9. In this embodiment, the system 500 includes five print head carriage rods 502*a-e*, each with a single print bar 504*a-e* having 6 print heads 506. During operation, these print bars are aligned so that the print heads are staggered to provide multi-pass coverage in 12 printing columns, like the embodiment of FIG. 8. This system includes a single service station 508, to which any one of the five print bars can be moved at any given time while the remaining print bars are active, in the manner discussed above.

The system and method disclosed herein contemplates a partially redundant page-wide array. That is, the number of redundant print heads or print bars is less than the number of active print heads or print bars (e.g. an array having just two active print heads or print bars would have only one redundant print head or print bar). When maintenance is complete on the at least one redundant print head or print bar, the recently serviced print head or print bar can replace one of the other print heads or print bars in the array, which can then undergo a maintenance routine. This approach allows a page-wide array to print continuously with the non-redundant portion of the array, while still conducting periodic print head maintenance operations. Instead of duplicating the entire page-wide array, one or more redundant print heads or print bars are used to achieve the same functionality with less cost and complexity.

This system and method also provides an additional aspect of functionality beyond the servicing of print heads. Specifically, the redundant print head(s) can also be used for printing activities when not being serviced. This allows printing to proceed using both the redundant print head and the remainder of the page-wide array before positionally and functionally interchanging the redundant print head for the new print head. For example, a redundant print head can be actuated to "cover" for another print head that has some weak nozzles. That is, the redundant print head can be moved to a printing position (i.e. a column in the page-wide array) that is occupied by the print head with weak nozzles, and caused to print in that column to make up for the poorly performing print head. This can be done in at least two ways. In one approach, the redundant print head is caused to print the data that the poorly performing print head would otherwise print. Alternatively, both the redundant print head and the poorly performing print head can be used at the same time, with print data shifted from one to the other. For example, if the system cannot fully recover 2 heads, part of one print head (e.g. the poorly performing print head) can be used for most data, and the missing areas can be filled in by positioning the redundant print head behind the poor region of the other.

Redundant print heads can also be used to improve print quality generally, such as to speed up multi-pass printing. For example, a 3-pass printing process can be sped up by ⅓ by using one or more redundant print heads to provide the same result in 2 print passes. In the first pass through the print array the redundant print head(s) can provide an additional ink application on part of the media, and then be shifted to provide an additional ink application on the remainder of the media in the second pass. This provides each part of the print media with three printing applications in only two passes. It is to be appreciated that this sort of approach can be used in a variety of different ways and with printing systems having different numbers of print heads or print bars and of redundant print heads or print bars.

Yet another characteristic of this system is that defective print heads can be replaced and calibrated without stopping the print engine. Specifically, the controller (70 in FIG. 1) can be configured to receive a servicing command that pre-empts the normal redundant print head exchange routine, allowing printing to continue while a technician services or replaces the redundant print head. In the logic that controls the print heads, this could be programmed as an indefinite temporal extension of the servicing interval, allowing a technician to perform whatever work is needed while printing continues. Following such an operation, the normal redundant print head service and exchange process can then resume. Likewise, it is to be appreciated that the same type of replacement or servicing operation can be performed with the multiple print head print bars shown in FIGS. 7-9.

Additionally, while the discussion presented above refers to a service station having spitting, priming and wiping devices for automatically servicing one or more print heads, these functions could also be performed manually. For example, the service station can simply be a position to which a print head or print bar can be moved to allow an operator to prime and wipe the print heads by hand, and possibly perform other operations.

It is to be understood that the above-referenced arrangements are illustrative of the application of the principles disclosed herein. It will be apparent to those of ordinary skill in the art that numerous modifications can be made without departing from the principles and concepts of this disclosure, as set forth in the claims.

What is claimed is:

1. A method for printing in an ink jet printer system having a page-wide array of print heads including a redundant print head, comprising:

moving the redundant print head to a service station;

printing using the remainder of the page-wide array while the redundant print head is at the service station; and positionally and functionally interchanging the redundant print head for a new print head of the page-wide array while printing continues.

2. A method in accordance with claim 1, further comprising the step of printing using the redundant print head and the remainder of the page-wide array before positionally and functionally interchanging the redundant print head for the new print head.

3. A method in accordance with claim 1, further comprising:

redesignating the new print head as the redundant print head; and repeating said interchanging until all print heads of the page-wide array have been moved to the service station.

4. A method in accordance with claim 1, wherein interchanging the redundant print head for the new print head comprises:

moving the redundant print head to a discrete position in the page-wide array that is occupied by the new print head; and transferring data from the new print head to the redundant print head, so that the redundant print head operationally takes the place of the new print head without substantially interrupting printing.

5. A method in accordance with claim 4, further comprising moving the new print head to the service station for servicing.

6. A method in accordance with claim 4, wherein moving the redundant print head to a discrete position comprises:

laterally transferring the redundant print head along a carriage device from the service station to the discrete position; and verifying an accuracy of positioning of the redundant print head at the discrete position using an optical encoder system associated with the carriage device.

7. A method in accordance with claim 4, further comprising:

redesignating the new print head as the redundant print head; and repeating said interchanging until all print heads of the page-wide array have been serviced.

8. A method in accordance with claim 4, further comprising repeating replacement of a print head in the array with a print head coming from having been serviced at the service station.

9. A method in accordance with claim 8, further comprising repeating replacement of a print head in the array with a print head coming from having been serviced at the service station until all print heads of the array have been serviced.

10. A method of printing with a printing system comprising an array of print heads, said array of print heads including a redundant print head, and a service station, said method comprising:

with the redundant print head located at the service station, printing using a remainder of the array of print heads; and positionally and functionally replacing a second print head in the array with the redundant print head while printing continues.

11. A method in accordance with claim 10, wherein replacing the second print head with the redundant print head comprises:

moving the redundant print head to a discrete position in the array that is occupied by the second print head; and transferring data from the second print head to the redundant print head, so that the redundant print head operationally takes the place of the second print head without substantially interrupting printing.

12. A method in accordance with claim 11, wherein moving the redundant print head to a discrete position comprises:

laterally transferring the redundant print head along a carriage device from the service station to the discrete position; and verifying an accuracy of positioning of the redundant print head at the discrete position using an optical encoder system associated with the carriage device.

13. A method in accordance with claim 10, further comprising, servicing the redundant print head at the service station prior to replacing the second print head with the redundant print head.

14. A method in accordance with claim 10, further comprising:

when the redundant print head is in place in the array, redesignating the second head as the redundant print head; and servicing the redesignated second print head at the service station.

* * * * *